United States Patent [19]

Bacon et al.

[11] 4,027,201

[45] May 31, 1977

[54] APPARATUS AND METHOD FOR NEUTRALIZING STATIC CHARGES IN SHEET/WEB FEEDING DEVICES

[75] Inventors: James Lydell Bacon; Jesse Wayne Spears, both of Boulder, Colo.

[73] Assignee: International Business Machines Corporation, Armonk, N.Y.

[22] Filed: Oct. 6, 1975

[21] Appl. No.: 620,096

[52] U.S. Cl. ..... 361/213

[51] Int. Cl.[2] ..... H05F 3/04

[58] Field of Search ..... 317/2 R, 2 A, 2 F, 262 A, 317/4

[56] References Cited

UNITED STATES PATENTS

| | | | |
|---|---|---|---|
| 1,940,536 | 12/1933 | Eyler | 317/2 A X |
| 2,576,882 | 11/1951 | Koole et al. | 317/2 A X |
| 3,237,068 | 2/1966 | Sowiak | 317/262 A |
| 3,456,109 | 7/1969 | Gawron | 317/262 A X |
| 3,475,652 | 10/1969 | Levy | 317/2 F |
| 3,717,801 | 2/1973 | Silverberg | 317/262 E |
| 3,790,854 | 2/1974 | Dryczynski et al. | 317/4 X |

*Primary Examiner*—Harry E. Moose, Jr.
*Attorney, Agent, or Firm*—John H. Holcombe; Homer L. Knearl

[57] ABSTRACT

A corona and associated electrical drive as shown herein, neutralize the static charges on non-conductive sheets or webs. The neutralization of static charge is accomplished by passing the material to be neutralized under a double wire corona. Both wires in the corona are connected to an AC signal. The AC signal drives both wires with a signal that alternates in polarity at frequency f. The wires are spaced apart a predetermined distance calculated from a function dependent upon the frequency of the AC signal and the speed of the paper moving under the corona wires. The predetermined distance is such that a given area of the paper will pass under one wire at a first polarity and under the second wire at the opposite polarity. Further enhancement of neutralization can be accomplished by using a second double wire corona out of phase with the first double wire corona. In addition the sheet or web as it passes under the corona wires is supported to prevent static charge on the support from balancing a static charge on the sheet or web. Accordingly, the only static charge present as the sheet or web moves under the corona is that charge carried by the sheet or web. The corona wires will neutralize that charge either by discharging it with oppositely charged ions or depositing oppositely charged ions to balance the charge already on the sheet or web. Thus as the sheet or web moves away from the neutralizing station the sheet or web has a net charge which is substantially zero.

19 Claims, 15 Drawing Figures

FIG. 1
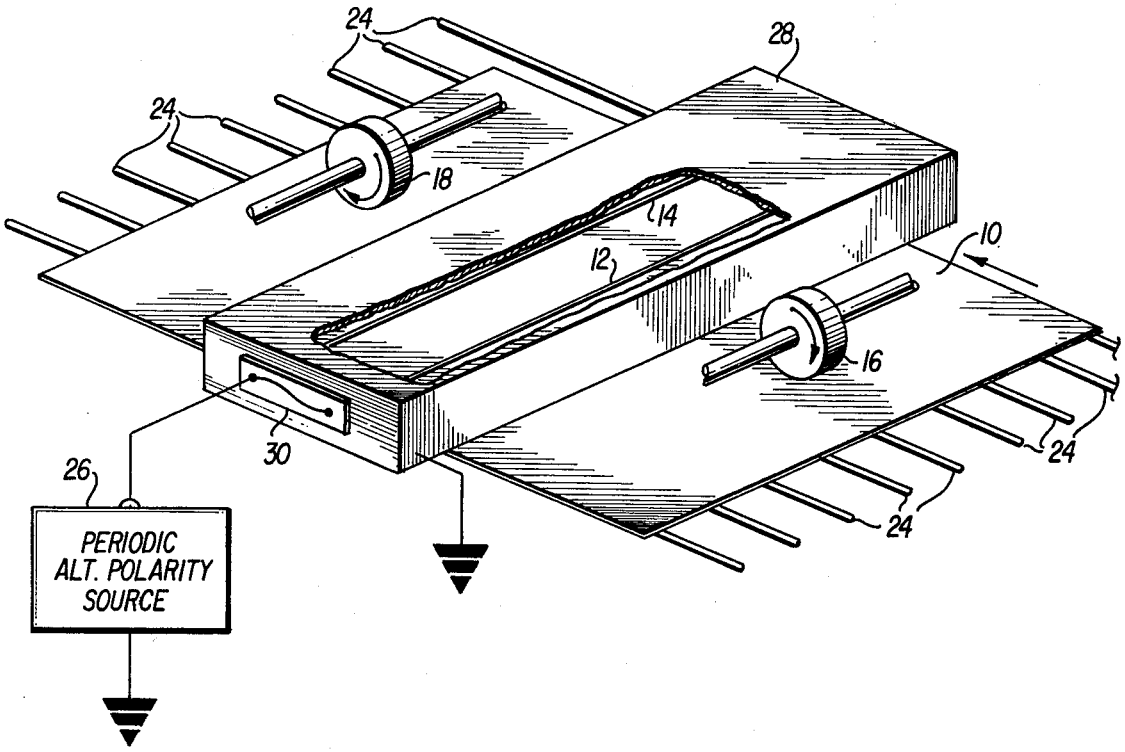
FIG. 3A (TIME $t_1$)
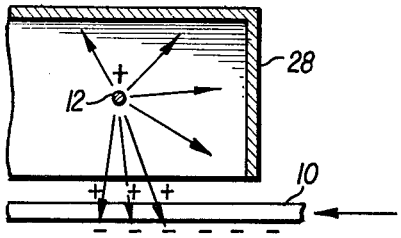
FIG. 4A (TIME $t_1$)
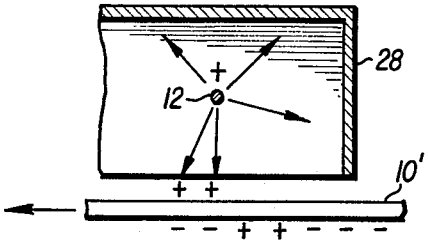
FIG. 3B (TIME $t_2$)
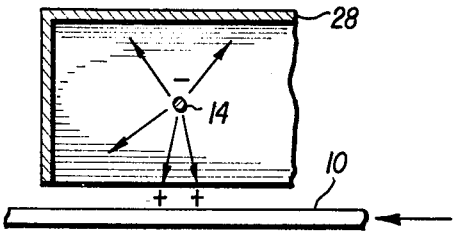
FIG. 4B (TIME $t_2$)
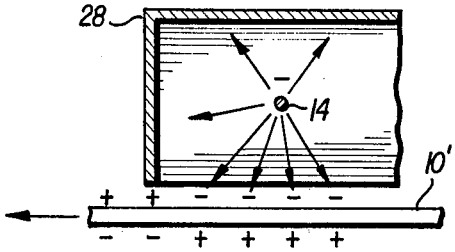

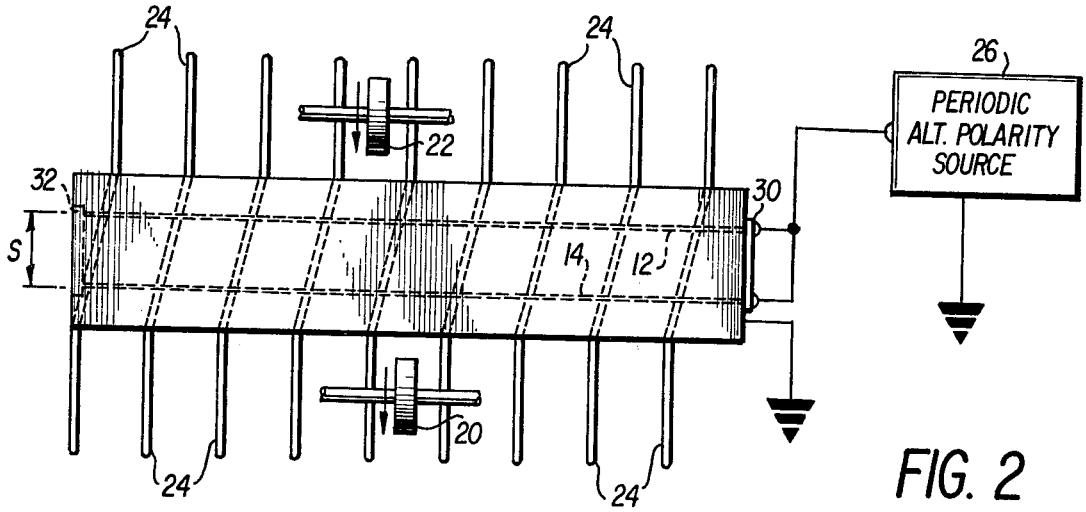
FIG. 2
FIG. 10A
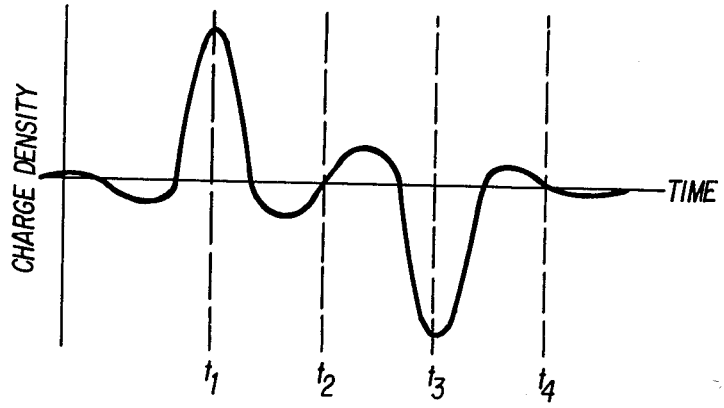
FIG. 10B
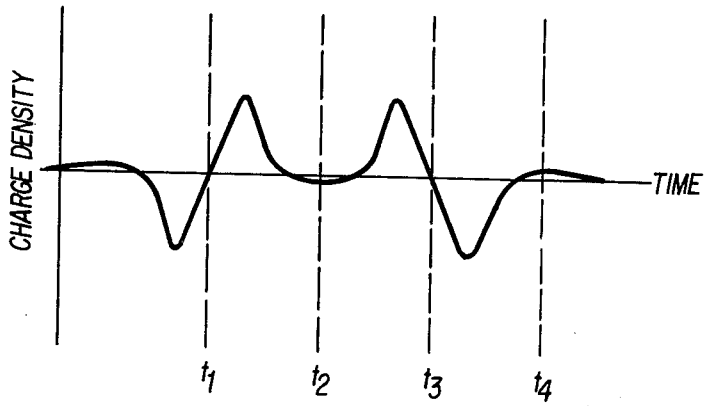

APPARATUS AND METHOD FOR NEUTRALIZING STATIC CHARGES IN SHEET/WEB FEEDING DEVICES

BACKGROUND OF THE INVENTION

1. Field of the Invention

This invention relates to neutralizing a static charge on sheets or webs. More particularly the invention relates to neutralizing charges on sheets or web stock that has passed through an electrophotography process. The electro-photography process tends to deposit large static charges on the sheet or web material.

2. Problem Review

In sheet or web handling it is well known that electrical charges can build up on non-conductive sheets or webs. Typically, paper stock or thin flexible plastic stock is being handled by the feeding apparatus. Motion of the feeding apparatus may create the static charges deposited upon the sheet or web being fed. These charges can cause sheet or webs to stick to the feeding apparatus thereby inhibiting the sheet handling or web handling function.

An even more serious problem occurs in the electrophotography art where paper stock or plastic transparencies are purposely given a large static charge during transfer of the image to the copy stock. Anyone familiar with use of copying equipment is well acquainted with the strong attraction between the copy sheets as they exit the copying machines. Even more serious than the inconvenience to the user of his copies sticking to one another is the problem of copies sticking and jamming automatic paper handling devices after the copy sheets move from the copier to paper handling devices such as collators.

Accordingly, one objective of the invention is to neutralize sheets or webs and particular copy sheets from a copier so that the copy sheets may be easily handled by an operator or sheet handling devices attached to a copier.

Use of coronas to produce various charge conditions on paper sheets is well known in electrophotography. Two examples include U.S. Pat. Nos. 3,237,068 and 3,717,801. These patents respectively deal with laying down a uniform charge on sheet material and reducing the charge on sheet material to assist in detaching sheet material from an electrostatic tacking plate. Neither of these patents is capable of neutralizing a sheet or a web. The support underlying the copy stock material at the corona in both of these patents can serve as a source of static charge. Further neither of these patents discusses the problem of neutralizing a copy sheet to substantially a net charge of zero.

In contrast, it is a further object of this invention to neutralize copy stock to a substantially net zero charge condition.

SUMMARY OF THE INVENTION

In accordance with this invention the above objects have been accomplished by passing the copy, either the sheet or web, under a double-wire neutralizing corona. The copy is carried under the corona by a non-conductive or charge-free support. Further the spacing between the wires of the corona and the electrical signals on the wires of the corona are such that a given point on the copy will see a signal of a first polarity at the first wire and a signal of the opposite polarity at the second wire.

The non-conductive support of the copy as it moves past the corona prevents the support from temporarily balancing any charge on the copy. Thus, the only charge present as the neutralizing copy moves past the corona is the charge carried by the copy. In this environment each of the wires producing the coronas will supply charge to discharge or balance charge one polarity of the charge carried by the copy.

The non-conductive support of the copy might take any number of forms. Non-conductive rubber belts or an air bearing from a non-conductive bearing surface might be used. Even a grid of conductive wires can be used to form an effective non-conductive support for the copy sheet or web. If each wire in the grid makes an angle other than 0° to the copy direction of motion a given point on the copy as it moves past the corona wires will be supported by a conductive wire only for a short distance of its travel. Accordingly while the point on the copy is between grid wires it may be discharged by the corona wires.

Neutralization of the copy sheet or web may either be accomplished by discharging the copy or by balance charging the copy. On typical copy paper charges will tend to migrate through the paper and be discharged. Accordingly, the neutralizing corona will neutralize such paper stock by discharging the charges on both surfaces of the copy paper. On the other hand transparent plastic stock will typically not permit charges on one surface to migrate through the transparent copy to discharge the other surface. For transparencies where charges may not migrate, the corona will neutralize the copy by balance charging the charges on the back of the copy with opposite charges on the corona side of the copy.

While a single pair of corona wires will neutralize the copy sheet or web, a further feature of the invention is that neutralization may be enhanced by the addition of at least a second pair of corona wires 90° out of phase with the first pair of corona wires. Their charge/discharge effect on the copy will insure that each point on the copy sees a substantial discharging signal of each polarity as it moves past the neutralizing corona.

The great advantage of our invention is that a sheet or web neutralized by the invention has substantially zero net charge either discharged or balanced. In the electrophotography art this greatly enhances paper handling as the copy sheets exit from the copying equipment.

The foregoing and other objects, features, advantages of the invention will be apparent from the following more particular description of preferred embodiments of the invention as illustrated in the accompanying drawings.

BRIEF DESCRIPTION OF DRAWINGS

FIG. 1 shows a preferred embodiment of the invention with a single pair of corona wires and a wire grid to support a sheet as it passes under the corona.

FIG. 2 is a top view of FIG. 1 particularly showing the separation between the corona wires and the angular positioning of the sheet support grid.

FIGS. 3A and 3B depict a pair of corona wires discharging a sheet or web.

FIGS. 4A and 4B show a pair of corona wires balance charging copy.

FIGS. 10A and 10B show the effective charge density applied to separate points on a sheet or web as each point moves under the neutralizing corona.

DETAILED DESCRIPTION

Figure 5:
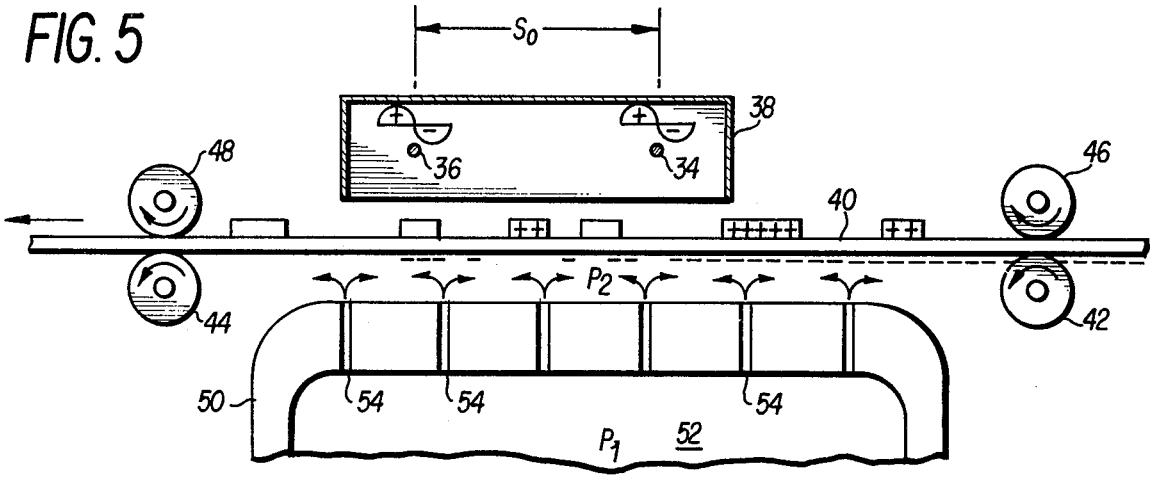
FIG. 5 is a cross-section of an alternate embodiment of the invention using a single pair of corona wires with an air bearing support for the sheet or web.

The preferred embodiment of the invention is shown in FIGS. 1 and 2. Document 10 to be neutralized is shown only in FIG. 1. Document or sheet 10 is fed under the corona wires 12 and 14 by feed rollers 16 and 18. Drive for these rollers is not shown as it forms no part of the invention. Upper feed rollers 16 and 18 of FIG. 1 cooperate with lower feed rollers 20 and 22 respectively, in FIG. 2. Rollers 16 and 18 are above the document 10 while rollers 20 and 22 are below the document 10. Rollers 20 and 22 operate as pinch rollers so that feeding rollers 16 and 18 can push document 10 past the corona wires 12 and 14.

As mentioned earlier the support of the document 10 as it moves under the corona wires must be effectively non-conductive.

If the support is conductive, charge flow in the support inhibits neutralization of the document. Neutralization occurs because charge on the document attracts opposite charge from the neutralizing corona. When the support is conductive, charge flow in the support can balance charges on the document as the document moves under the corona. Then the charged document does not attract charge from the corona. After the document leaves the conductive support it is still charged.

As document 10 is driven past the corona wires 12 and 14 it is supported by a grid of wires 24. Although wires 24 are preferably non-conductive they may be made from conductive metal. When the wires 24 are in fact conductive they should form an angle with the direction of motion of document 10 as shown in FIG. 2. The effective result is non-conductive support of document 10 in the vicinity of the corona wires 12 and 14.

The angle or bend in the support wires 24 insures that a given point on document 10 as it moves under the corona wires is only adjacent a support wire 24 for a very short interval. Accordingly, even if the support wires 24 are conductive they will have little or no affect in inhibiting the neutralization function of the corona wires 12 and 14.

To accomplish the neutralization the corona wires 12 and 14 are driven in synchronism with a periodic alternate polarity signal from source 26. Corona wires 12 and 14 are mounted inside the conductive corona shield 28 which is grounded. Physical connections between the corona wires 12 and 14 and the corona shield 28 are on insulation blocks 30 and 32. Corona wires 12 and 14 are supplied in parallel by the same signal from the periodic alternate polarity source 26. The distance $S_0$ between the corona wires 12 and 14 is an odd multiple of ½ the neutralization wavelength. The neutralization wavelength, λ, is given by the following expression:

$$\lambda = V_s/f$$

The distance $S_0$ beween the corona wires 12 and 14 is a function of the velocity $V_S$ of the document 10 as well as the frequency f of the periodic signal so that a given point on the document 10 will see opposite polarity charges on the corona wires 12 and 14 as the point passes under the wires. The neutralization operation can be better understood by referring to FIGS. 3A and 3B for discharging and FIGS. 4A and 4B for balance-charging.

In FIG. 3A a discharge operation is depicted under corona wire 12 at time $t_1$. It is assumed at this instant of time that the polarity of the corona wires is positive. Accordingly, positive ionization of the air is taking place about corona wire 12. Positive charge flows to the shield 28 and also towards negative charges on the document 10. As depicted in FIG. 3A the negative charges are on the backside of the document while all of th positive charges are on the corona side of document 10. When corona wire 12 is positive the positive charges on document 10 are unaffected. However, the negative charges on document 10 are discharged by the migration of positive charge from corona wire 12 through the paper document 10.

In FIG. 3B the same point on document 10 at time $t_2$ has now reached a position under corona wire 14. As discussed above the spacing between corona wires 12 and 14 is such that when the same point of document 10 reaches corona wire 14 both corona wires 12 and 14 will now be negatively biased. The negative voltage on corona wire 14 produces negative ionization of the air. The negative charges will flow to the corona shield 28 and to the document 10 as demanded by positive charges on document 10. If there were no positive charges on document 10 there would be little or no negative charge flow towards the document 10. Thus in FIG. 3B at time $t_2$ the positive charges on document 10 are discharged by flow of negative charge from corona wire 14. Since the same point on the document 10 was previously negatively discharge at time $t_1$ by corona wire 12, document 10 now moves out from under corona shield 28 completely discharged.

In FIGS. 4A and 4B a dielectric sheet 10′ such as transparent plastic is neutralized by balance charging rather than discharging. At time $t_1$ a given point on dielectric sheet 10′ is positioned under the corona wire 12. At time $t_1$ corona wires 12 and 14 have a positive bias. Therefore the air around corona wire 12 is positively ionized and positive charge flows to the shield 28 as depicted in FIG. 4A. In addition, if there are negative charges on the dielectric sheet 10′, positive charges will flow based on this negative charge demand. The charge flow is to the upper surface of sheet 10′ because the charges can not migrate to sheet 10′, negative charge on the back of sheet 10′ will be balanced by positive charge on the top of sheet 10′.

Subsequently at time $t_2$ as depicted in FIG. 4B the same point on sheet 10′ will be under corona wire 14. At time $t_2$ corona wires 12 and 14 will have a negative bias and thus negative charge will flow to the corona shield 28 and to the sheet 10′. Negative charge will flow to sheet 10' only on demand. Thus, if there is positive charge on the upper surface of sheet 10' which is not balanced out by negative charge on the bottom of sheet 10', negative charge will flow through the upper surface to discharge that positive charge. Further, if there is positive charge underneath the sheet 10' which is not balanced by negative charge on the top of sheet 10', then negative charge will flow to the top of sheet 10' to balance the positive charge. Thus as a sheet 10' leaves the corona shield 28 it will have a balanced condition and substantially net 0 charge.

An alternative embodiment also depicting the dishcarge of a web is shown in FIG. 5. The neutralization corona consists of corona wires 34 and 36 with a corona shield 38. The corona wires are separated by distance $S_0$ where $S_0 = N(\lambda/2)$ and N is an odd number. The corona wires are driven by a periodic alternating polarity signal source just as shown in FIG. 1. The corona wires 34 and 36 are driven in synchronism as depicted by the sinusoidal wave forms above the corona wires in FIG. 5. Web 40 is driven past the corona wires 34 and 36 by drive rollers 42 and 44, operating in conjunction respectively with pinch rollers 46 and 48. Drive for the drive rollers 42 and 44 is not shown as it forms no part of the invention.

The non-conductive support for the embodiment in FIG. 5 is provided by an air-bearing plenum 50. Plenum 50 has a chamber 52 which is supplied with an air pressure $P_1$ from a pressue supply not shown. Any number of pneumatic pressure devices might be chosen to pressurize chamber 52 to pressure $P_1$. Air flows from chamber 52 through holes 54 in the plenum 50. Air flow out of the holes 54 under the web 40 generates an air film of a pressure $P_2$ between the web 40 and the surface 56 of plenum 50. The pressure $P_2$ supports the web 40 above the surface 56 of plenum 50.

The advantages of the air bearing support of web 40 is that this is a non-conductive support of web 40 as it moves under the corona wires 34 and 36. If the air bearing thickness is not great enough to insure non-conductive support of web 40 then the plenum 50 should also be made of a non-conductive material.

FIG. 5 also shows the effect of the neutralization corona on the web as it moves under the corona wires 34 and 36. In the electrophotography art the web 40 would typically be a paper web having a substantial continuous negative charge on its back surface and pockets of positive charge on its upper surface associated with deposits of toner material. As the web 40 is moved under the corona wires 34 and 36, from right to left, part of the charges are discharged at corona wire 34 and the remainder of the charges are discharged at corona wire 36. Thus, as the web moves off to the left it has been neutralized.

Figure 6:
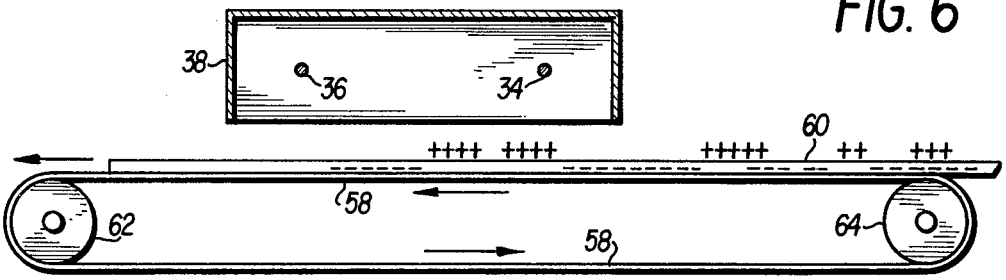
FIG. 6 is another embodiment of the invention showing a single pair of corona wires and a non-conductive flexible belt to carry the sheet past the neutralizing corona.

An alternative to the air bearing support in FIG. 5 is the non-conductive conveyor belt shown in FIG. 6. Belt 58 in FIG. 6 carries a sheet 60 from right to left under a neutralizing corona. The neutralizing corona is substantially the same as that shown in FIGS. 1 and 5 and corresponding parts in FIGS. 5 and 6 have been given the same reference numerals.

Belt 58 is preferably made of non-conductive rubber. It passes around pulleys 62 and 64. Either pulley 62 or 64 may be driven to move the belt 58 and thereby carry the document 60 under the corona wires 34 and 36. As sheet 60 moves under the corona wires 34 and 36 from right to left it is being discharged. As shown in FIG. 6, the corona wires 34 and 36 are positively charged and thus the negative charges under corona wire 36 are being discharged and the positive charges under corona wires 34 are unchanged. Since the corona wire 34 and 36 are separated by an odd multiple of one-half of the neutralization wavelength $\lambda(\lambda V_S/f)$ and since the corona wires are driven by AC signal in synchronism all areas of the sheet 60 will see both polarities after having moved under both wires. Therefore, sheet 60 as it moves away from the neutralizing corona has a substantially 0 net charge.

Figure 7:
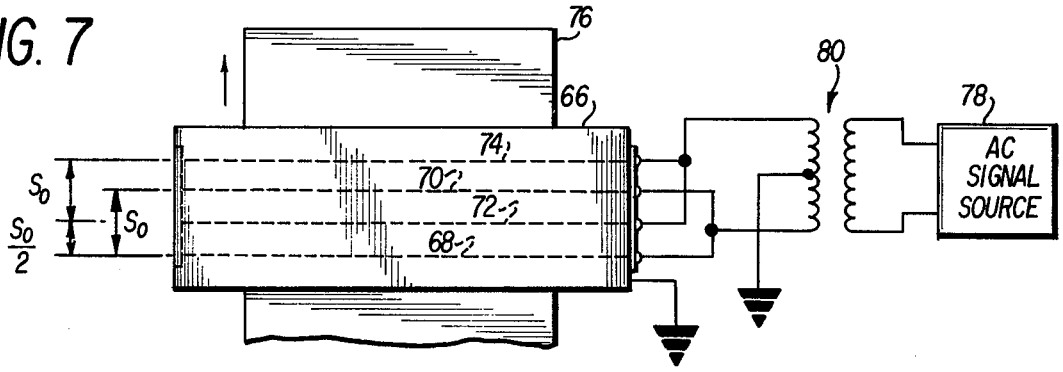
FIG. 7 shows an embodiment of the invention utilizing two pairs of corona wires driven with opposite phase signals.
Figure 8:
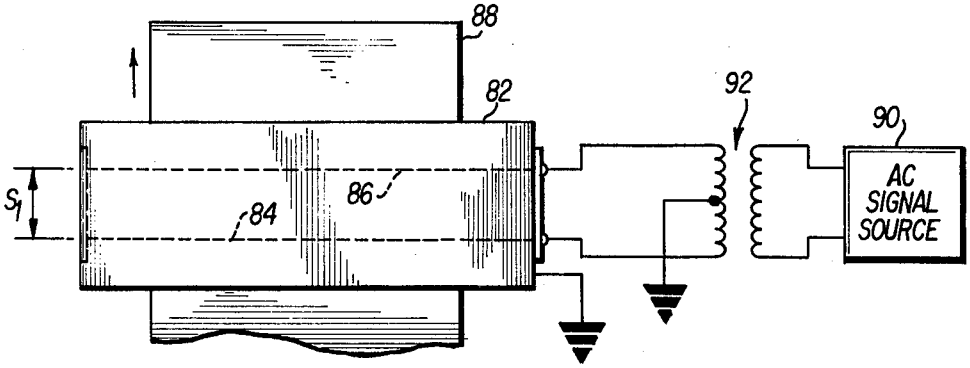
FIG. 8 shows another embodiment of the invention using a single pair of corona wires with signals of opposite polarity applied to each wire.

Alternative embodiments shown in FIGS. 7 and 8 use both positive and negative AC signals applied simultaneously to the corona wires. In FIG. 7 two pairs of corona wires are driven while in FIG. 8 a single pair of corona wires is driven.

In the embodiments described sofar only two corona wires have been used and these wires have been driven simultaneously by the same A.C. signal and separated by odd multiples of one-half the neutralization wavelength. Of course, more corona wires might be added. Preferably they should be added as pairs to insure that a given point on the sheet or web is always exposed to an equal number of positive and negative cycles. Otherwise it is possible that a small remanent charge might be left on the sheet by the neutralization corona.

In implementing a single pair of corona wires as described n FIGS. 1 through 6 hereinabove one difficulty can be encountered. The signals applied to both wires are in synchronism and are periodically varying between positive and negative. If a point on the copy sheet being discharged passed under one wire while the signal is zero going from plus to minus the same point will pass under the succeeding wire in the pair when the signal is again zero but going from minus to plus. Thus, a given point on the sheet or web will pass under the corona wires when there is a low signal level on the corona wires.

This zero crossing difficulty can be minimized in two ways. First, the frequency of the AC signal driving the corona wires may be selected so that the odd multiple factor "N" for the distance between corona wires is at least 3. The effectiveness of this solution will be discussed hereinafter in a comparison of FIGS. 9B and 10B. The second solution to this difficulty is to use a second pair of corona wires spaced in an interlace fashion one-quarter of the neutralization wavelength $\lambda$ from the first corona wires. This second solution guarantees that a given point on a sheet being discharged will see signal peaks under one pair of corona wires if it is seeing signal zero crossings under the other pair of corona wires. An embodiment of the invention implementing this second solution to the difficulty is shown in FIG. 7.

Neutralizing corona 66 in FIG. 7 contains two pair of corona wires. Corona wires 68 and 70 form one pair while corona wires 72 and 74 form the other pair. Each pair of corona wires are separated by the distance $S_0$ where:

$$S_0 = N\ (\lambda/2)$$

$$\lambda = V_S/f)$$

$$N = 1, 3, 5, 7 \ldots.$$

In addition, the two pairs are separated by a distance $S_0/2$ which corresponds to one-fourth of an odd multiple of a neutralization wavelength $\lambda$.

A sheet 76 to be neutralized is shown passing under the neutralization corona. Drive to move the sheet 76 and support structure to carry the sheet 76 under the neutralization corona 66 are not shown. Any of the methods used in FIGS. 1, 2, 5 and 6 might be selected.

The periodic alternate polarity source for neutralization in corona 66 is an AC signal source 78. The AC signal from source 78 is connected to the pairs of corona wires through a center tap transformer 80. The center tap of the secondary winding of transformer 90 is grounded. Thus, the AC signal applied to the pair 68 and 70 is 180° out of phase with the AC signal applied to corona pair 72,74. This configuration insures that a point on the sheet being discharged will see a significant amount of positive and negative charge as it flows under the neutralizing corona. the charge density applied to a given point on a sheet being discharged can best be understood by reference to FIGS. 9 and 10. However, before preceeding to the charge density wavefroms in FIGS. 9 and 10 another embodiment of the invention is shown in FIG. 8.

Neutralization corona 82 in FIG. 8 contains a single pair of corona wires 84 and 86. The sheet or web 88 to be neutralized is schematically represented moving under the neutralization corona 82 in FIG. 8.

The embodiment of the invention in FIG. 8 is different in that the signals applied to the corona wires 84 and 86 are 180° out of phase. Thus, the separation distance as $S_1$ the corona wires 84 and 86 must be a multiple of the neutralization $$S_1 = N\lambda$$

$$\lambda = V_s/f$$

$$N = 1, 2, 3, 4 \ldots.$$

wavelength. This will insure that a given point on the sheet 88 that passes corona wires 84 while the corona wire is positive, will pass corona wire 86 while the corona wire 86 is negative. Corona wires 84 and 86 are driven with AC signal source 90 through a grounded center tap transformer 92.

The embodiment of FIG. 8 will have the same difficulty with the zero crossing problem previously discussed. The problem may be solved in the same manner. First, the AC signal frequency may be selected so that the lowest multiple of the neutralization wavelength is 2. Alternatively, the zero crossing difficulty can be solved in substantially the same manner as depicted in FIG. 7.

To adapt FIG. 7 to handle two pairs of FIG. 8 coronas requires a few modifications. First, the spacing between corona wires of the same pair becomes $S_1$ as in FIG. 8, instead of $S_0$. Second, the spacing between the corona pairs becomes $S_1/2$ instead of $S_0/2$. Finally, the first two wires in the two pairs must be connected in common to one terminal of the transformer secondary, while the last two wires in the two pairs are connected in common to the other terminal of the secondary.

Figure 9A:
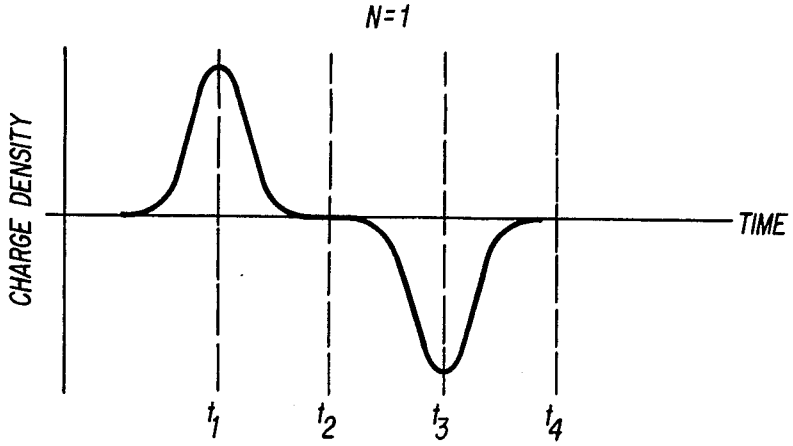
FIGS. 9A through 9C show the effective charge density seen by separate points on a sheet or web as each point moves under the neutralizing corona.
Figure 9B:
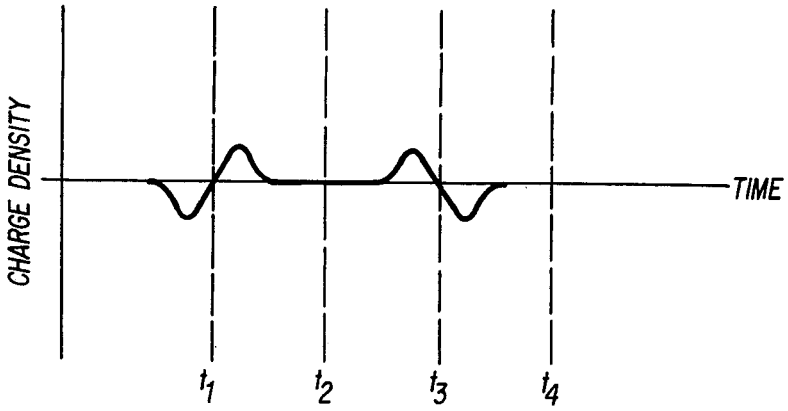
Figure 9C:
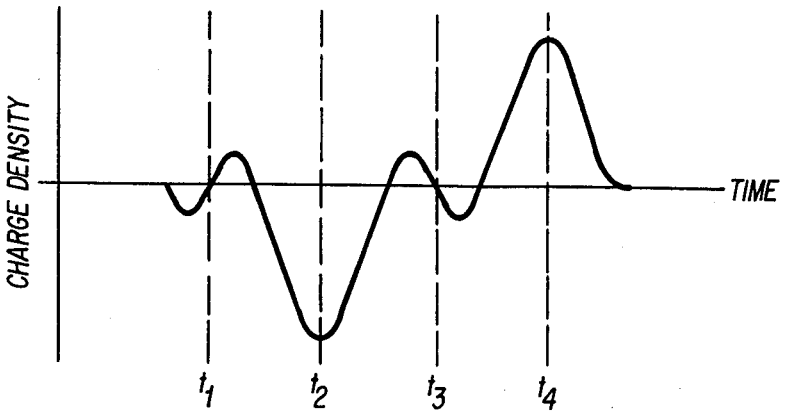

The operation of the various embodiments of the invention will now be reviewed with reference to the waveforms in FIGS. 9 and 10. These waveforms represent the charge density to which a given point on a sheet or web being neutralized is exposed as it moves under the neutralization corona. The series of waveforms making up FIGS. 9A through 9C are waveforms where the odd multiple factor N equals 1. The waveforms making up FIGS. 10A and 10B are waveforms where the odd multiple factor N equals 3.

FIG. 9A depicts the charge density seen by a point on document 10 (FIG. 1) as it moves under the corona wires 12 and 14. Further FIG. 9A depicts a point that sees corona wire 12 at a maximum positive voltage and the corona wire 14 at maximum negative voltage. As the point moves under the neutralizing corona, and approaches the corona wire 12 the charge density builds because the voltage on corona wire 12 is increasing and because the point is getting closer to the corona wire 12. A time $t_1$ the point is directly under the corona wire 12 and voltage on the corona wire 12 is positive maximum voltage.

As the point moves away from the corona wire 12 the charge density available to discharge the point goes down because the voltage on the corona wire 12 is decreasing and the point is also moving away from the corona wire. At time $t_2$ the point is midway between the two corona wires 12 and 14 but is receiving no charge density from the corona wires because at this time the signal is applied to the corona wires is going through the zero crossing point. In addition, the point is far enough away from the corona wires that it would be receiving little or no charge density even if there were potential on the wires.

As the point on document 10 approaches wire 14, corona wire 14 is going negative in voltage. Thus, the charge density applied to the point goes more and more negative until at time at $t_3$ maximum negative voltage is applied to corona wire 14, and the point is directly under corona wire 14. The point then moves away from corona wire 14 as the negative voltage decreases to zero.

FIG. 9A represents the optimum neutralization condition for a point. For points on document 10 that do not align with the corona wires at time of maximum voltage, the neutralization signals are not as strong. The worst case is depicted in FIG. 9B where a point on the document passes under the corona wires 12 and 14 just as the signal applied to the wire is crossing the zero voltage level.

In 9B, the point on document 10 is approaching corona wire 12 at time $t_1$ and corona wire 14 at time $t_3$. As the point approaches corona wire 12 it begins receiving a negative charge whose density increases (goes more negative) as the point gets closer to corona wire 12. However, since the voltage applied to corona wire 12 is decreasing rapidly towards zero the charge density available to the point rapidly decreases. At time $t_1$ voltage on corona wire 12 is swinging through zero from negative to positive, and no charge is available to the point as it moves directly under the wire 12. As the point moves away from the wire 12 the voltage on the wire 12 is building rapidly positive. However, before much charge builds up the separation between the point and the wire becomes great enough to reduce the charge density available to the point on the document.

At time $t_2$ voltage on the corona wires 12 and 14 is at a maximum, however, the point on the document is sufficiently far away from the corona wires and little or no charge density reaches that point. The document continues to move and as the point approaches corona wire 14 it begins to get close enough to receive some positive charge from corona wire 14. As the point on document 10 approaches wire 14 the voltage on the corona wire is decreasing from positive through the zero crossing point to negative. As the point moves away from corona wire 14 the negative voltage is building on the wire. However, the charge density to the point on the document 10 is decreasing with the increased distance of the point from the corona wire 14. Accordingly, after a short negative excursion after time $t_3$ in FIG. 9B, the charge density available to the point falls back to zero. Thus, as can be seen in FIG. 9B, a point, that happens to align with the corona wires while the voltage on the wires is passing through zero, receives very little exposure to charge from the corona wires. This is the zero crossing problem discussed above.

If a second corona pair is added as in FIG. 7, then the charge density waveform for the same point the document represented by FIG. 9B becomes the charge density waveform of FIG. 9C. When a point on document 76 (FIG. 7) moves under the four corona wires, it sees the charge density waveform of FIG. 9C. At time $t_1$, under corona wire 68 the potential on wire 68 and thus the charge density in 9C is a positive going zero crossing. As the point moves in the vicinity of corona wire 68 it sees a small negative charge followed bya small positive charge.

When the point on document 76 reaches corona wire 72 at time $t_2$, voltage on corona wire 72 is at its negative maximum. The point then sees a maximum negative charge at time $t_2$. Further along at time $t_3$ the point is under corona wire 70 where it is exposed to a negative going zero crossing. Under wire 70 very little discharge takes place since the point only sees a small positive charge followed by a small negative charge.

Finally, at time $t_4$, the point on document 76 has moved under corona wire 74. At time $t_4$ corona wire 74 is at its maximum positive voltage. Thus, the point sees a maximum positive charge at time $t_4$.

A comparison of FIGS. 9B and 9C indicate how the four wire neutralizing corona configuration has solved the zero crossing problem. In FIG. 9C even though a point on a document may see zero crossing conditions at times $t_1$ and $t_3$ it will see large positive and negative charge conditions at times $t_2$ and $t_4$. Although not shown, the converse is true where the point on the document sees zero crossings at times $t_2$ and $t_4$. Such a point will than see large positive and negative charges at times $t_1$ and $t_3$. The alternative solution to the zero crossing problem is depicted in FIGS. 10A and 10B. As discussed above the alternative solution is to use a higher odd multiple of the neutralization wavelength. In FIGS. 10A and 10B the odd multiple N is 3. Times $t_1$ and $t_3$, in FIGS. 10A and 10B correspond to times when the point on document 10, FIG. 1, is under corona wires 12 and 14 respectively. In FIG. 10A the point passes the corona wires at a peak voltage while in FIG. 10B the point is under the wires during zero crossing.

The charge density waveform in FIG. 10A is substantially the same as that in FIG. 9A except the frequency is higher. Accordingly, the charge density pulses at times $t_1$ and $t_3$ are more narrow and are preceded and followed by short pules of opposite polarity.

A comparison of FIG. 10B and 9B shows the similarity in waveforms except that in FIG. 10B the positive and negative swings on each side of the crossing point are larger. This is due to the fact that in FIG. 10B the odd multiple wavelength is shorter. Thus, the charge seen by the point before it moves away from the corona wires has a chance to grow more rapidly before its effectiveness is lost because the point is separated from the corona wire. Therefore, the zero crossing difficulty has been obviated, as shown in FIG. 10B, by increasing the frequency so that a point on document 10 sees a bigger positive and negative swing on each side of the zero crossing point.

While a number of alternative embodiments have been suggested and may more combinations will occur to those skilled in the art, the preferred embodiment is that shown in FIG. 1. Some specific examples of dimensions for an operative embodiment in FIG. 1 are as follows.

Sheet/Web Velocity=30 in./sec.

AC Source Frequency=60Hz

Separation between corona wires and walls of corona =¼ in.:⅛ in.

Separation between corona wires and sheet or web=3/10 in.

$S_0 = 3/4$ in.

While the invention has been described for various alternative embodiments and while a specific example has been given of a preferred embodiment it will be apparent to one skilled in the art that various other changes and modifications to the embodiments shown could be made without departing from the spirit and scope of the invention.

What is claimed is:

1. Apparatus for neutralizing static electric charge on a sheet or web moving at a velocity Vs relative to said neutralizing apparatus, said neutralizing apparatus comprising:

first means for ionizing gas adjacent said sheet or web;

second means for ionizing gas adjacent said sheet or web;

means electrically connected to said first and second ionizing means for supplying a periodic alternate polarity signal of a frequency $f$ to said first and second ionizing means so that periodically each ionizing means produces positive and negative ions;

means for supporting the sheet or web with a substantially charge-free support adjacent said first and second ionizing means whereby charges on said sheet or web alone will attract ions to neutralize the sheet or web as the sheet or web moves relative to said first and second ionizing means;

said first and second ionizing mean points of said gas ionization adjacent said sheet or web separated a predetermined distance along the direction of relative motion, said predetermined distance being a multiple of 1/2 Vs/f such that a given point on the sheet or web attracts ions of a first polarity as the point moves past the first ionizing means and attracts ions of a second polarity as the point moves past the second ionizing means.

2. The apparatus of claim 1 and in addition conductive shield means adjacent said first and second ionizing means for attracting ions not attracted by said sheet or web whereby said first and second ionizing means effectively supply ions on demand to said sheet or web depending upon the charges on said sheet or web.

3. The apparatus of claim 2 wherein said supporting means comprises means for generating an air film to support said sheet or web as it moves relative to said first and second ionizing means.

4. The apparatus of claim 2 wherein said supporting means comprises a non-conductive rubber belt for carrying the sheet or web past said first or second ionizing means.

5. The apparatus of claim 2 wherein said supporting means comprises:

a grid of conductive wires for supporting the sheet or web as the sheet or web moves past said first and second ionizing means;

each of the wires forming the support grid making an angle other than 0° with the direction of relative motion of the sheet or web whereby a given point on the sheet or web overlays a wire for a very small percentage of the time interval that the sheet or web is moving past said first and second ionizing means.

6. The apparatus of claim 2 wherein said supplying means comprises means for supplying simultaneously a periodic alternate polarity signal of a frequency $f$ in phase to both said first and second ionizing means; and said predetermined distance of said first and second ionizing means points of said gas ionization adjacent said sheet or web comprises an odd multiple of 1/2 Vs/f.

7. The apparatus of claim 2 wherein said supplying means comprises:

means electrically connected to said first and second ionizing means for transforming a periodic alternate polarity signal of a frequency $f$ into two periodic alternate polarity signals of opposite phase, one of the phases of said alternate polarity signal being connected to said first ionizing means while the other phase of said alternate polarity signal is connected to said second ionizing means;

an electrical signal source connected to said transforming means for generating the periodic alternate polarity signal; and said predetermined distance of said first and second ionizing means points of said gas ionization adjacent said sheet or web comprises a multiple of $Vs/f$.

8. Apparatus of claim 6 and in addition:

third ionizing means for ionizing gas adjacent said sheet or web;

fourth ionizing means for ionizing gas adjacent said sheet or web;

means electrically connected between said supplying means and said third and fourth ionizing means for transforming the periodic alternate polarity signal from said supplying means into an identical signal 180° out of phase with the signal supplied to said first and second ionizing means;

said third and fourth ionizing means being separated said predetermined distance from each other and one-half said predetermined distance from said first and second means so that each point on the sheet or web will have a significant density of positive and negative ions to attract from as the point moves under either the first or second ionizing means or the third and fourth ionizing means.

9. In an electrophotographic copy machine using electrostatic charge to develop and transfer the copy image to a copy sheet, apparatus for neutralizing the electrostatic charges onthe copy sheet after the copy image transfer and while the copy sheet moves at a relative velocity Vs to the neutralizing apparatus, said neutralizing apparatus comprising:

a source of alternating current having a frequency $f$;

a first plurality of wires mounted across and adjacent to the path of the copy sheetand electrically connected in common to said source for producing alternate positive and negative coronas, said wires separated approximately from each other by an odd multiple of one-half the neutralization wavelength where the neutralization wavelength equals $V_S \div f$; $f$;

said copy sheet receiving charge from said coronas on demand depending upon the quantity of electrostatic charge on said copy sheet and differences between the polarity of each corona and the polarity of charge on the copy sheet as the copy sheet moves past each wire.

10. The apparatus of claim 9 and in addition:

charge-free support for supporting the copy sheet adjacent said wires as the copy sheet moves past said wires, said support being effectively charge free so that the demand on the corona for charge by said copy sheet is unaffected by said support.

11. The apparatus of claim 10 wherein said charge free support comprises:

a support grid of conductive wires, each wire in the grid being small in cross section relative to the aerial dimension of the copy sheet, each grid wire in the region of the coronas making an angle of at least a few degrees with the direction of motion of the copy sheet, whereby the copy sheet overlays a conductive wire for a very short interval of time as the copy sheet moves past the coronas.

12. The apparatus of claim 10 and in addition:

a conductive shield mounted adjacent said pluralities of wires to draw from the coronas charges in excess of the charge required to neutralize the copy sheet.

13. The apparatus of claim 9 and in addition:

a second plurality of wires mounted across and adjacent to the path of the copy sheet and electrically connected in common to each other and to said source but to the opposite phase of alternating current connected to said first plurality of wires, said wires in said second plurality of wires separated approximately from each other by an odd multiple of one-half the neutralization wavelength, and said first plurality of wires is separated from said second plurality of wires by an odd multiple of one-fourth the neutralization wavelength.

14. In an electrophotographic copying machine using an electrostatic charge to develop and to transfer the copy image to a copy sheet, apparatus for neutralizing the electrostatic charges on the copy sheet after the copy image transfers and while the copy sheet moves with relative velocity $V_S$ to the neutralizing apparatus, said neutralizing apparatus comprising:

a two-phase source of alternating current having a frequency $f$ with 180° separating the two phases;

a plurality of wires mounted across and adjacent to the path of the copy sheet, each of the wires parallel to each other and spaced along the path of the copy sheet, alternate wires across the path of the copy sheet being connected electrically to opposite phases from said source for producing positive and negative coronas;

each of said wires separated approximately from each other by a multiple of the neutralization wavelength where the neutralization wavelength equals $V_S \div f$;

said copy sheet charges attracting a charge from said coronas upon demand depended upon the electrostatic charge on said copy sheet and the difference between the polarity of each corona and the polarity of charge on the copy sheet as the copy sheet moves past each wire.

15. The apparatus of claim 14 and in addition:

charge free support for supporting the copy sheet adjacent said wires as the copy sheet moves past said wires, said support being effectively charge free so that the demand on the coronas for charge by said copy sheet is unaffected by said support.

16. The apparatus of claim 14 and in addition:

a second plurality of wires identical in separation and electrical connection with said first plurality of wires and mounted so that said second plurality of wires interlaces with said first plurality of wires, the interlace spacing between said first and second plurality of wires being equal to one-half the neutralization wavelength.

17. Method for neutralizing electrostatically charged sheet or web as the sheet or web moves past a neutralizing corona comprising the steps of:

supplying charge of one polarity as a given point on the sheet or web moves past one neutralizing corona wire, said charge being supplied on demand dependent upon quantity and polarity of the electrostatic charge on said given portion and depending upon the polarity of the charge being supplied by the corona wire;

supplying charge on the opposite polarity as said given portion of the sheet or web moves past a second neutralizing corona wire;

supporting said sheet or web in a substantially nonconductive environment as it moves past said corona wires whereby only the charge on the sheet or web is effective in demanding charge from said corona wires; and alternating the polarity of charge in said supplying steps at a frequency directly related to the relative velocity of the sheet or web to the neutralizing corona and indirectly related to the separation between said corona wires, the frequency of alternation being such as to insure that a given portion of the sheet or web will see both said polarities of charge as it moves past the neutralizing corona.

18. The method of claim 17 wherein said alternating step alternates the polarity of charge supplied by said supplying steps in phase when said corona wires are separated approximately by an odd multiple of one-half the neutralization wavelength where the neutralization wavelength equals velocity of the sheet or web relative to the neutralizing corona divided by the frequency of alternation.

19. The method of claim 17 wherein said alternating step comprises:

alternating the polarity of charge in one of said supplying steps 180° out of phase with the alternation in other of said supplying steps when the corona wires are separated by a multiple of the neutralization wavelength where the neutralization wavelength equals the velocity of the sheet or web relative to the neutralizing corona divided by the frequency of alternation.

* * * * *